US007024863B2

(12) United States Patent
Morenko

(10) Patent No.: US 7,024,863 B2
(45) Date of Patent: Apr. 11, 2006

(54) COMBUSTOR ATTACHMENT WITH ROTATIONAL JOINT

(75) Inventor: Oleg Morenko, Mississauga (CA)

(73) Assignee: Pratt & Whitney Canada Corp., Lonqueuil (CA)

( * ) Notice: Subject to any disclaimer, the term of this patent is extended or adjusted under 35 U.S.C. 154(b) by 147 days.

(21) Appl. No.: 10/614,349

(22) Filed: Jul. 8, 2003

(65) Prior Publication Data

US 2005/0016182 A1 Jan. 27, 2005

(51) Int. Cl.
*F23R 3/60* (2006.01)

(52) U.S. Cl. ..... 60/796; 60/752; 60/800

(58) Field of Classification Search ..... 60/796, 60/800, 722, 752, 753
See application file for complete search history.

(56) References Cited

U.S. PATENT DOCUMENTS

| | | | | |
|---|---|---|---|---|
| 2,615,300 | A | 10/1952 | Lombard | |
| 3,007,308 | A | 11/1961 | Rahaim et al. | |
| 3,078,071 | A | 2/1963 | Henny et al. | |
| 3,672,162 | A * | 6/1972 | Rygelis et al. | 60/800 |
| 3,991,560 | A | 11/1976 | DeCorso et al. | |
| 4,074,520 | A | 2/1978 | Mansson et al. | |
| 4,441,323 | A | 4/1984 | Colley | |
| 4,597,258 | A | 7/1986 | Harris | |
| 4,686,823 | A | 8/1987 | Coburn et al. | |
| 5,088,279 | A | 2/1992 | MacGee | |
| 5,289,677 | A | 3/1994 | Jarrell | |
| 5,392,596 | A | 2/1995 | Holsapple et al. | |
| 5,400,586 | A | 3/1995 | Bagepalli et al. | |
| 5,457,954 | A | 10/1995 | Boyd et al. | |
| 5,465,571 | A | 11/1995 | Clark | |
| 5,916,142 | A | 6/1999 | Snyder et al. | |
| 6,490,868 | B1 * | 12/2002 | Bunce et al. | 60/803 |

* cited by examiner

*Primary Examiner*—Louis J. Casaregola
(74) *Attorney, Agent, or Firm*—Ogilvy Renault LLP

(57) ABSTRACT

A gas turbine engine with: a compressor section; a turbine section; a combustor, disposed between the compressor and turbine sections, having at least one combustor mounting assembly connecting the combustor to the engine. Each combustor mounting assembly has: a longitudinal axis; and an articulating joint having a first and second portion constrained from relative translation transverse to the longitudinal axis, and where said first and second portion have a multiple rotational degrees of freedom relative to each other about axes transverse to the longitudinal axis.

17 Claims, 6 Drawing Sheets

COMBUSTOR ATTACHMENT WITH ROTATIONAL JOINT

TECHNICAL FIELD

The invention relates to a gas turbine engine combustor mounting assembly which facilitates relative sliding translation and rotation between the combustor and engine casing.

BACKGROUND OF THE ART

During gas turbine engine operation cycles, the thermally induced strain, i.e.: expansion and contraction of the combustor duct walls relative to the surrounding engine casing, is conventionally accommodated by fixing the upstream end of the combustor, either with the fuel nozzle support tubes or other combustor supports, and permitting the downstream end to expand and contract relatively freely in an axially sliding joint. The axial component of the thermally induced strain is generally accommodated by an sliding axial joint at the downstream outlet end of the combustor, whereas the radial component of thermally induced strain may be accommodated by means effectively securing the combustor such that the combustor is restrained axially at the upstream end while radial movement is accommodated by various combustor mounting devices.

Due to the harsh temperature environment and the need for simple, robust, maintenance free, and low cost mechanical devices to mount the combustor, conventional combustor mounting assemblies include simple devices such as a cylindrical locating pin slidably engaged in a combustor boss within a cylindrical recess for example which prevents lateral translation transverse to the pin while permitting relative sliding movement between the cylindrical pin and the cylindrical recess within the combustor boss.

It is an object of the present invention to provide a simple robust low cost combustor mount assembly that can accommodate the harsh temperature levels of the combustor and accommodate thermally induced expansion and contraction.

Further objects of the invention will be apparent from review of the disclosure, drawings and description of the invention below.

DISCLOSURE OF THE INVENTION

The invention provides a gas turbine engine with: a compressor section; a turbine section; a combustor, disposed between the compressor and turbine sections, having at least one combustor mounting assembly connecting the combustor to the engine. Each combustor mounting assembly has: a longitudinal axis; and an articulating joint having a first and second portion constrained from relative translation transverse to the longitudinal axis, and where said first and second portion have a multiple rotational degrees of freedom relative to each other about axes transverse to the longitudinal axis.

DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION OF PREFERRED EMBODIMENTS

Figure 1:
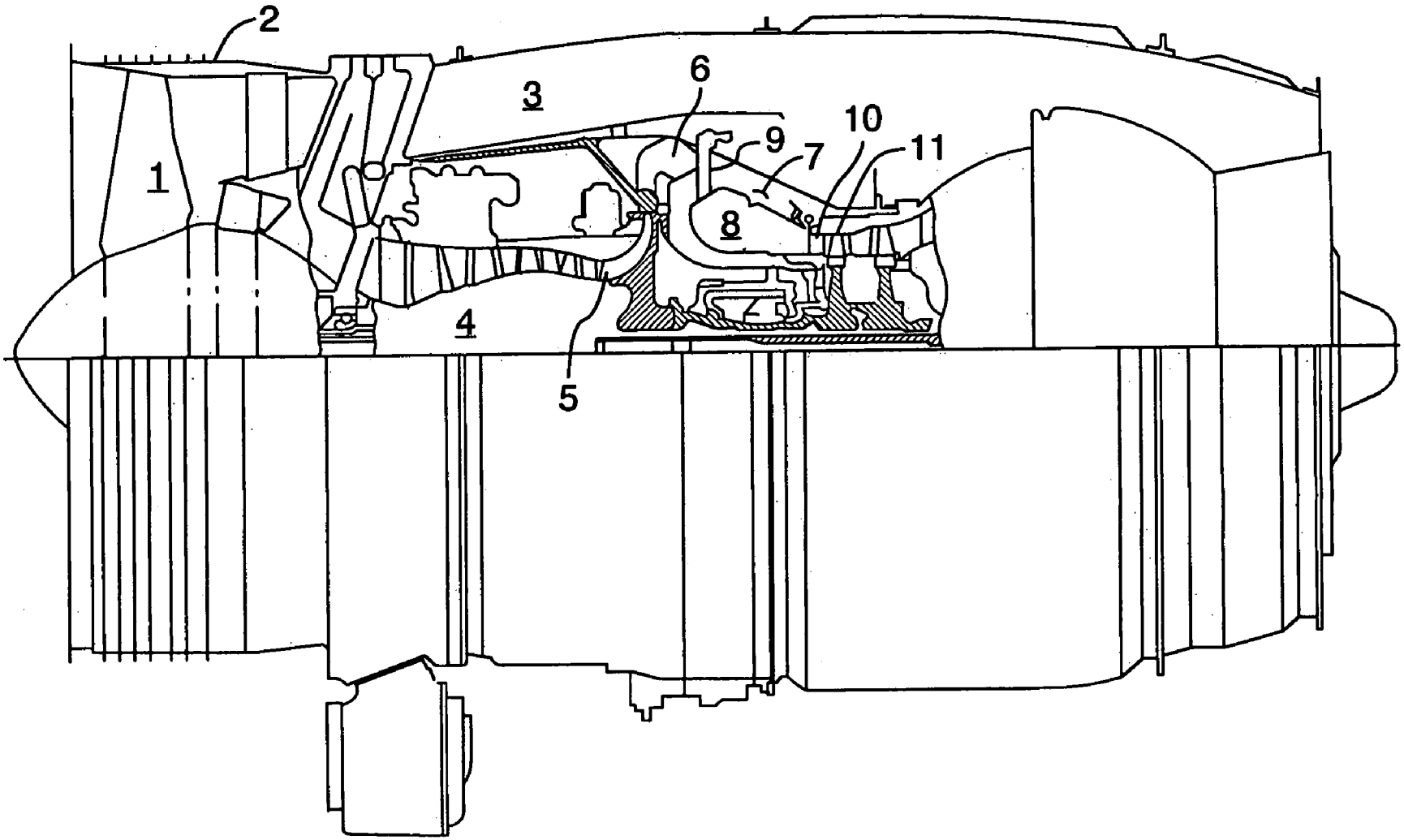
FIG. 1 is an axial cross-sectional view through a typical turbofan gas turbine engine showing the arrangement of engine components and specifically the combustor housed within the compressed air plenum and supplied with liquid fuel via fuel nozzles.

FIG. 1 shows an axial cross-section through a typical turbofan gas turbine engine. It will be understood however that the invention is applicable to any type of engine with a combustor and turbine section such as a turboshaft, a turboprop, auxiliary power unit, gas turbine engine or industrial gas turbine engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel nozzles 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vanes 10 and turbines 11 before exiting the tail of the engine as exhaust. It will be understood that the foregoing description is intended to be exemplary of only one of many possible configurations of engine suitable for incorporation of the present invention.

Figure 2:
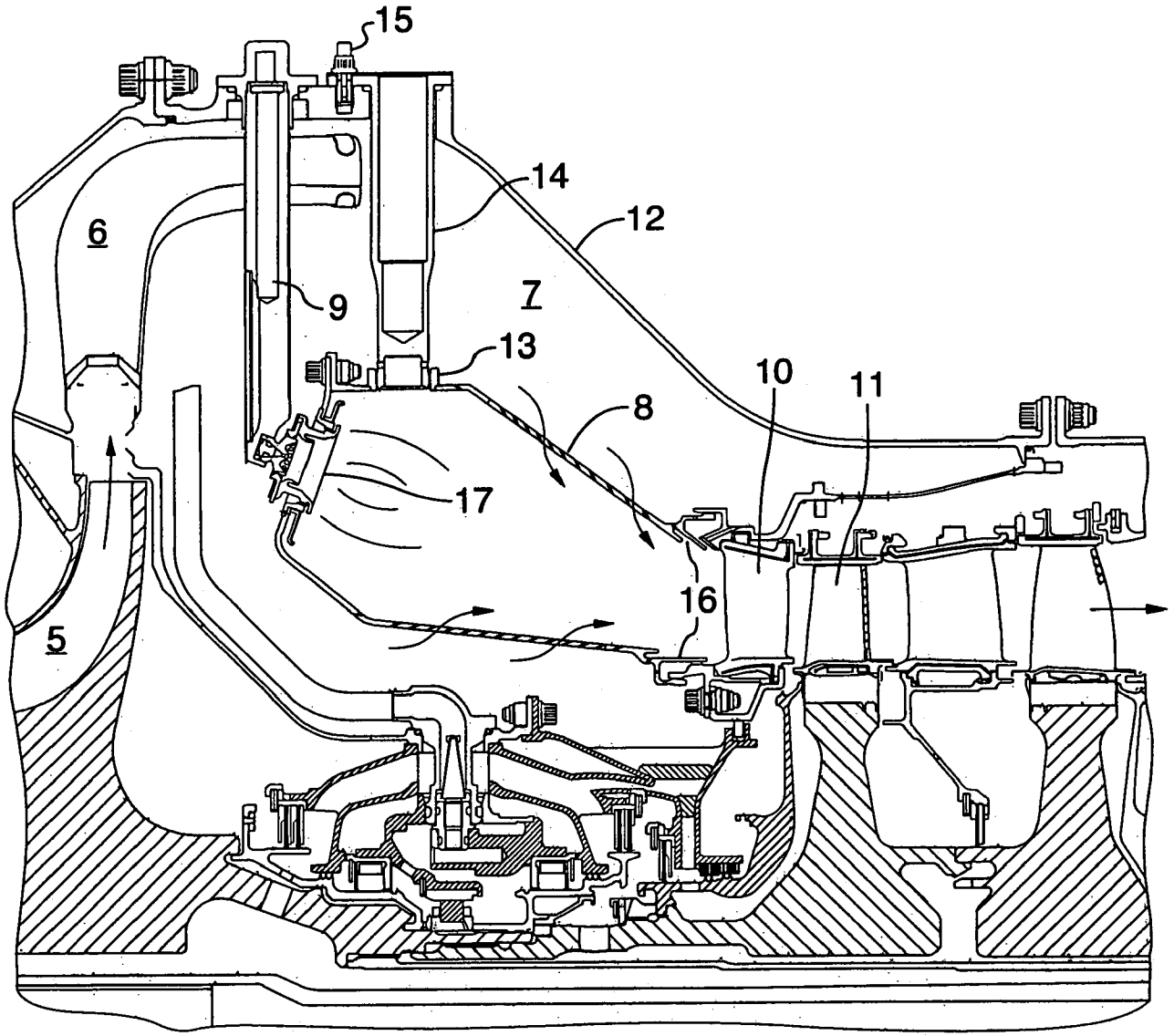
FIG.2 (Prior Art)
FIG. 2 is an axial sectional view through the area surrounding the combustor showing a fuel nozzle and a conventional combustor mount assembly secured to the relatively thin duct walls of the combustor.
Figure 3:
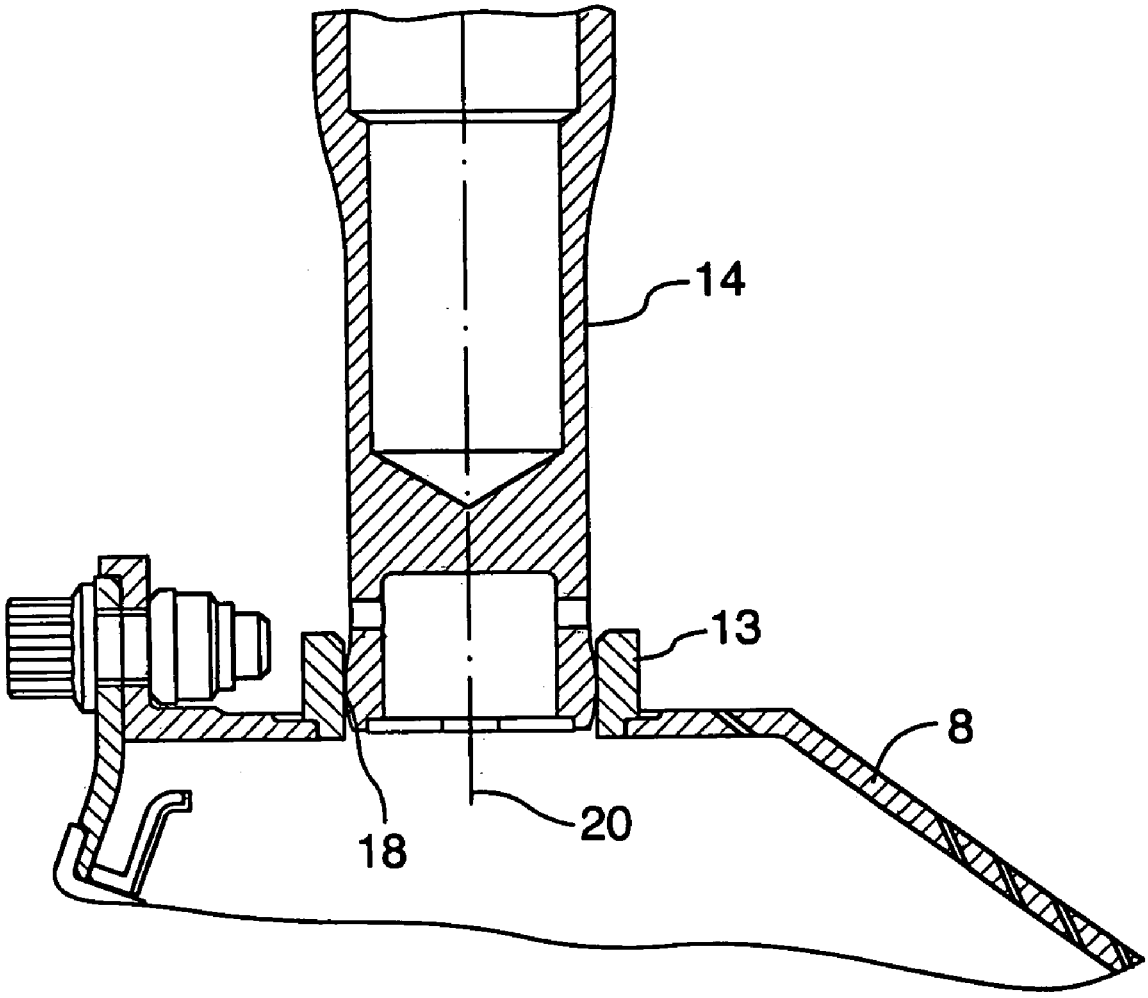
FIG.3 (Prior Art)
FIG. 3 is a detailed axial sectional view of through a conventional combustor boss with combustor locating pin inserted therein.

FIG. 2 shows a detailed view of the area of the engine surrounding the combustor 8 in a conventional gas turbine engine whereas FIG. 3 shows a detailed view of the prior art connection between the combustor boss 13 and the locating pin 14. As best seen in FIG. 2, the pin 14 is rigidly connected at an outer end to the plenum casing 12 with bolt 15 for example whereas the inward end of the pin 14 restrains axial motion of the boss 13 and combustor 8 while permitting sliding in a generally radial direction between the boss 13 and the inner end of the pin 14. As shown in FIG. 2, the downstream end of the combustor 8 includes an axial sliding joint 16 between the combustor 8 and the nozzle guide vane 10. The combustor nozzles 17 are mounted to the end wall of the combustor 8 using a floating collar connection of a type well known to those skilled in the art that accommodates relative movement caused by varying thermal conditions.

FIG. 3 shows details of the inner end of the prior art pin 14 which is inserted into the combustor boss 13. The prior art boss 13 has an internal cylindrical surface which is engaged by a spherical portion 18 formed on the inward end of the pin. A disadvantage of this conventional arrangement however is that fretting occurs between the spherical portion 18 and the cylindrical interior surface of the combustor boss 13 due to the limited contact surface between these components. Effectively, the contact surface amounts to a relatively thin band around the periphery of the spherical portion 18 which is subjected to relative movement, vibration stress and is exposed to the heat of gases contained within the combustor 8.

Figure 4:
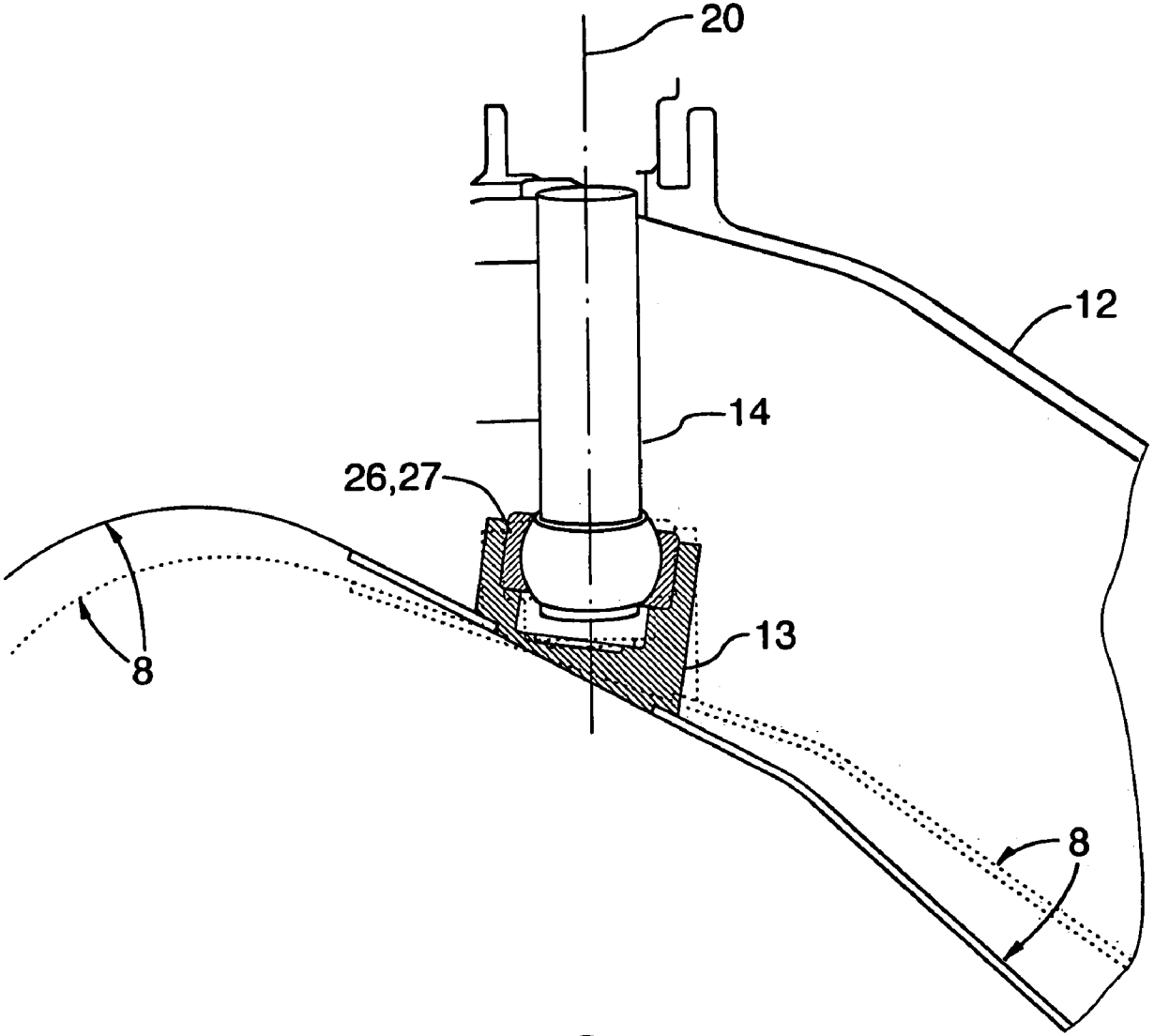
FIG. 4 is a like axial sectional view through a combustor mount assembly in accordance with the present invention showing a preferred example with a spherical articulating joint that is also slidably disposed within the combustor boss.
Figure 5:
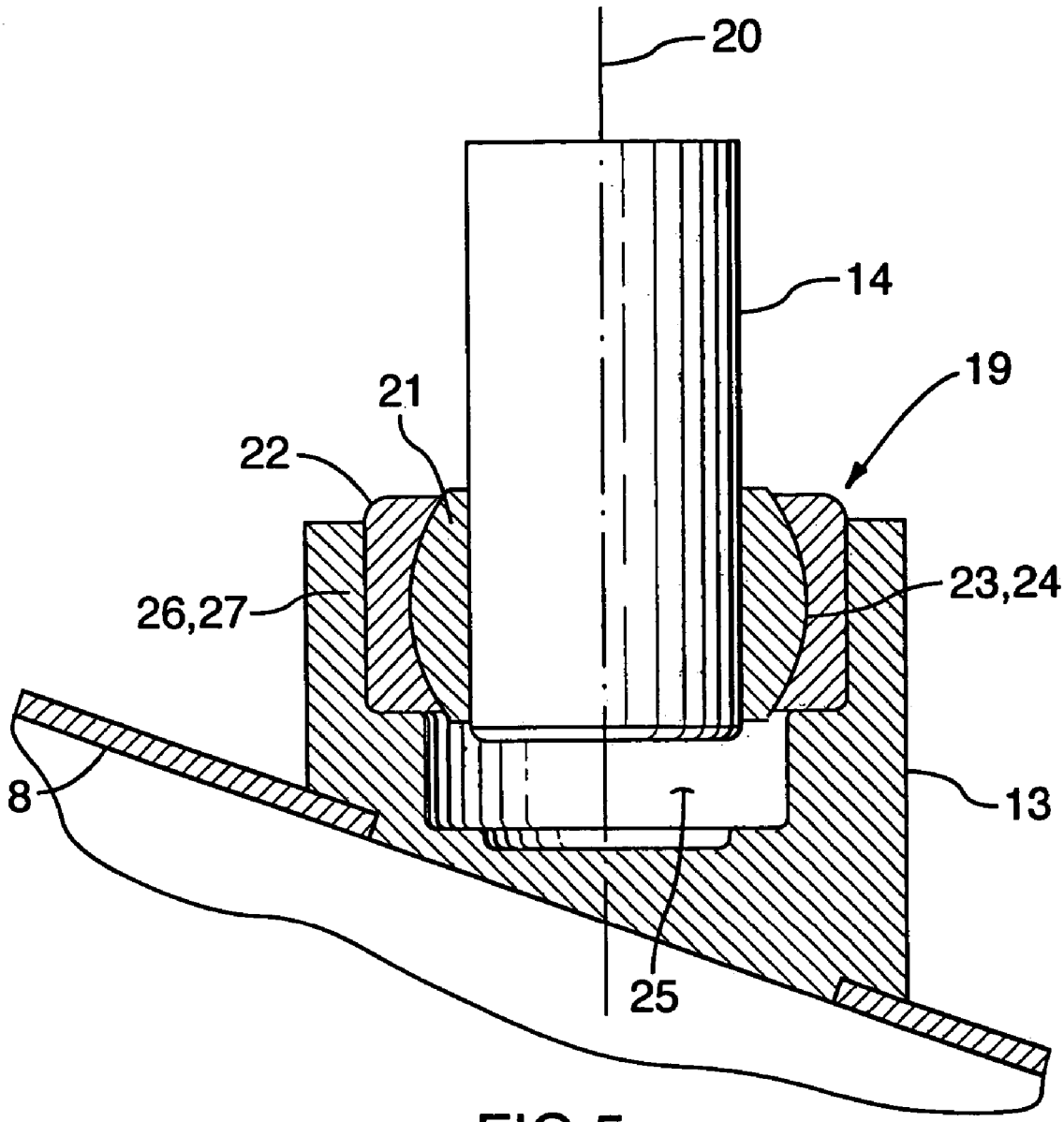
FIG. 5 is a detailed sectional view of the articulating joint showing spherical sliding surfaces and cylindrical sliding surfaces between the assembled components.
Figure 6:
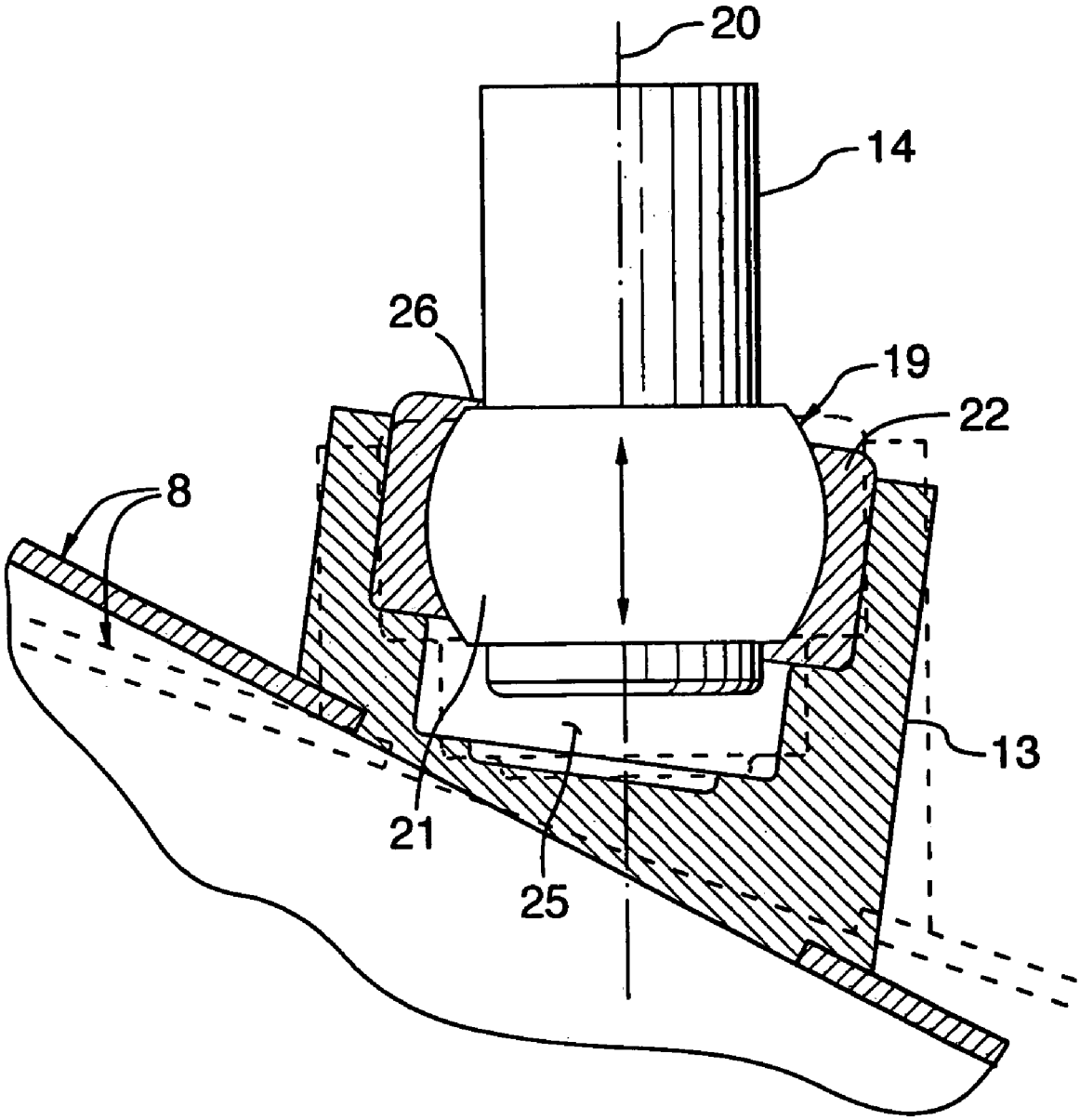
FIG. 6 is a further detailed view illustrating the ability of the articulating joint to accommodate misalignment during installation or operation of the engine.

FIGS. 4, 5 and 6 show details of an embodiment of the invention which provides distinct advantages over the prior art. The combustion boss 13 need not pass entirely through the wall of the combustor 8 and therefore does not necessarily expose the associated components to combustion gases. Further, it will be apparent to those skilled in the art that during an engine overhaul or retrofit the conventional combustor mounting assembly (which is shown in FIGS. 2 and 3) can be easily replaced and upgraded by the invention shown in FIG. 4 replacing the combustor boss 13 and optionally the pin 14 if necessary. It is contemplated however that the pin 14 may simply be re-machined to accept the articulating joint 19, the details of which will be described below.

Referring to FIG. 4, the combustor mounting assembly of the present invention connects the combustor 8 to the engine structure, in the embodiment illustrated, consisting of the plenum casing 12. Each combustor mounting assembly has a longitudinal axis 20, which is typically aligned radially relative to the engine, and includes an articulated joint 19. The articulating joint 19 has a first portion 21 and second portion 22 which mate and engage on convex and concave surfaces, and are thereby constrained from relative translation in a direction transverse to the longitudinal axis 20 by engagement within the combustor boss 13 (it being understood that a direction which is "transverse" to the longitudinal axis 20 is one which has a component which is normal to axis 20). However, as best illustrated in FIGS. 4 and 5, the first and second portions 21 and 22 of the articulating joint 19 have a plurality of rotational degrees of freedom relative to each other about multiple axes transverse to the longitudinal axis 20 of course, in the application shown, the degree of rotational movement required around the rotational axes transverse to the longitudinal access is very limited but is sufficient to provide for the expected thermal expansion and contraction as indicated. As also shown in FIG. 6 with arrow aligned with the longitudinal axis 20, the articulating joint 19 has a translational degree of freedom parallel to the longitudinal axis 20.

In the example shown, the simple robust structure of the articulating joint 19 includes at least one longitudinal slide surface. For example, as shown in FIG. 5, the external cylindrical slide surface of the articulating joint 19 is slidably housed within the internal cylindrical surface 24 of the boss 13. Therefore, the articulating joint 19 is free to slide parallel to the longitudinal axis 20 relative to the boss 13 while it is constrained transverse to the longitudinal axis 20 by mechanical interference between the cylindrical slide surfaces 23 and 24.

Alternatively, or in addition to the above described mechanism, the pin 20 can be designed with clearance relative to the first portion 21 such that the exterior surface of the pin 14 constitutes a cylindrical external slide surface and the internal surface of the first portion 21 can comprise a cylindrical internal slide surface. To this end, the combustor boss 13 includes a hollow chamber 25 to permit clearance of the end of the pin 14 and accommodate radial movement of the boss 13 and combustor 8 relative to the stationary pin 14.

In the embodiment shown, the combustor mounting assembly includes an outwardly projecting boss 13 and the articulating joint 19 is housed entirely within the internal surface of the boss 13. It will be apparent to those skilled in the art however, that this is not the only arrangement possible within the teaching of the invention. For example, the pin 14 may comprise a hollow tube and the first and second portions 21 and 22 may be fitted within a tubular pin 14. In such an alternative, the boss 13 would comprise an interior stud that is restrained within the interior surface of the first portion 21. Many other examples within the teaching of the invention will be recognized by those skilled in the art, such as replacing the spherical articulating joint 19 with a ball in socket joint, a universal joint, a gimble device, or a linkage structure.

In the embodiment shown in FIGS. 4, 5 and 6, the first and second portion 21, 22 of the articulating joint 19 have opposing spherical joint surfaces 26 and 27. The first and second portions 21 and 22 are shown as mutually nested sleeves however other arrangements are certainly possible such as a ball and socket joint. However due to limited range of movement that is required for this application, the size of the spherical surfaces 26 and 27 can also be limited.

Comparison between FIG. 5 and FIG. 6 will illustrate a further advantage of the invention in that the articulating joint 19 not only serves to accommodate relative rotational movement between the combustor 8 and the pin 14, as well as relative radial movement, but further the articulating joint is mounted to accommodate any misalignment in the installation. FIG. 6 shows a misalignment between the second portion 22 and the interior surface of the combustor boss 13. Further FIG. 6 shows downward protrusion of the bottom of the pin 14 into the hollow chamber 25.

In conclusion therefore, the invention provides a relative simple, inexpensive and robust means to join the combustor 8 to the engine while accommodating thermal expansion and contraction that adapts to relative radial movement and rotational movement simultaneously. The invention may be applied to newly manufactured engines and to retrofit applications with relative ease.

Although the above description relates to a specific preferred embodiment as presently contemplated by the inventor, it will be understood that the invention in its broad aspect includes mechanical and functional equivalents of the elements described herein.

I claim:

1. A gas turbine engine comprising:

a compressor section;

a turbine section;

a combustor, in flow communication with the compressor and turbine sections;

at least one combustor mounting assembly adapted to support the combustor within the engine, the combustor mounting assembly having: a longitudinal axis; and an articulating joint having; a first portion; a second portion; and at least one longitudinal slide surface, the first and second portions having mating concave and convex curved surfaces, said curved surfaces each having a curvature in two mutually orthogonal planes, wherein the articulating joint has a translational degree of freedom parallel to said longitudinal axis and wherein said first and second portion have a plurality of rotational degrees of freedom relative to each other about axes transverse said longitudinal axis.

2. A gas turbine engine according to claim 1 wherein the combustor mounting assembly includes an outwardly projecting boss.

3. A gas turbine engine according to claim 2 wherein the articulating joint is housed within an internal surface of the boss.

4. A gas turbine engine according to claim 3 wherein an external slide surface of the articulating joint is slidably housed within said internal surface of the boss, and wherein the joint is free to slide parallel said longitudinal axis relative to the boss while constrained transverse said longitudinal axis.

5. A gas turbine engine according to claim 1 wherein the combustor mounting assembly includes a pin engaging at least one of the first and second portions of the articulating joint.

6. A gas turbine engine according to claim 5 wherein the articulating joint includes an internal slide surface, and the pin has an external slide surface.

7. A gas turbine engine according to claim 1 wherein the first and second portions of the articulating joint have opposing spherical joint surfaces.

8. A gas turbine engine according to claim 7 wherein the first and second portions are mutually nested sleeves.

9. A combustor for a gas turbine engine, the combustor comprising:

at least one combustor mounting assembly having: a longitudinal axis; and an articulating joint having a first and second portion, the first and second portions having mating concave and convex curved surfaces, said curved surfaces each having a curvature in two mutually orthogonal planes to provide opposing spherical joint surfaces, said first and second portion having a plurality of rotational degrees of freedom relative to each other about axes transverse said longitudinal axis, and wherein the first and second portions are mutually nested sleeves.

10. A combustor according to claim 9 wherein the articulating joint has a translational degree of freedom parallel to said longitudinal axis.

11. A combustor according to claim 10 wherein the articulating joint comprises at least one longitudinal slide surface.

12. A combustor according to claim 9 wherein the combustor mounting assembly includes an outwardly projecting boss.

13. A combustor according to claim 12 wherein the articulating joint is housed within an internal surface of the boss.

14. A combustor according to claim 13 wherein an external slide surface of the articulating joint is slidably housed within said internal surface of the boss, and wherein the joint is free to slide parallel said longitudinal axis relative to the boss while constrained transverse said longitudinal axis.

15. A combustor according to claim 11 wherein the combustor mounting assembly includes a pin engaging at least one of the first and second portions of the articulating joint.

16. A combustor according to claim 15 wherein the articulating joint includes an internal slide surface and the pin has an external slide surface.

17. A combustor for a gas turbine engine, the combustor comprising:

a pin having a longitudinal axis and a first spherical surface slidingly engaging a second mating spherical surface of a combustor boss, wherein at least one of the pin and boss includes one of: an internal longitudinally sliding surface; and an external longitudinally sliding surface.

* * * * *